US011053731B2

(12) United States Patent
Lin

(10) Patent No.: US 11,053,731 B2
(45) Date of Patent: Jul. 6, 2021

(54) SKYLIGHT ROLLER SHADE WITH A CABLE CONE INDEXING MECHANISM

(71) Applicant: Crestron Electronics, Inc., Rockleigh, NJ (US)

(72) Inventor: Fang Lin, Staten Island, NY (US)

(73) Assignee: Crestron Electronics, Inc., Rockleigh, NJ (US)

( * ) Notice: Subject to any disclaimer, the term of this patent is extended or adjusted under 35 U.S.C. 154(b) by 274 days.

(21) Appl. No.: 16/423,879

(22) Filed: May 28, 2019

(65) Prior Publication Data

US 2020/0378180 A1 Dec. 3, 2020

(51) Int. Cl.

| | |
|---|---|
| ***E06B 9/42*** | (2006.01) |
| ***E06B 9/58*** | (2006.01) |
| ***E06B 9/72*** | (2006.01) |
| *E04D 13/03* | (2006.01) |

(52) U.S. Cl.

CPC ..... *E06B 9/42* (2013.01); *E06B 9/58* (2013.01); *E06B 9/72* (2013.01); *E04D 13/03* (2013.01)

(58) Field of Classification Search

CPC ..... E06B 9/42; E06B 9/58; E06B 9/72; E04D 13/03

See application file for complete search history.

(56) References Cited

U.S. PATENT DOCUMENTS

| | | | |
|---|---|---|---|
| 1,050,459 | A | 1/1913 | Hotaling |
| 1,134,326 | A | 4/1915 | Gambon |
| 1,446,747 | A | 2/1923 | Hoyt |
| 4,673,018 | A | 6/1987 | Judkins |
| 4,880,045 | A | 11/1989 | Stahler |
| 5,035,091 | A | 7/1991 | Ebato |
| 5,163,495 | A | 11/1992 | Lichy |

(Continued)

OTHER PUBLICATIONS

Crestron Electronics, Inc., Skylight Shade, Installation Guide—DOC. 7539A, (2036704), Sep. 2013.

*Primary Examiner* — Beth A Stephan
(74) *Attorney, Agent, or Firm* — Crestron Electronics, Inc.

(57) ABSTRACT

A roller shade adapted to adjustably cover a structural opening comprising a pair of longitudinal side panel assemblies each comprising a tensioning assembly and adapted to be attached at opposite sides of the structural opening and a roller tube assembly adapted to be attached to and between the pair of longitudinal side panel assemblies. The roller tube assembly comprises a roller tube comprising at least one channel and a shade material attached to the roller tube and adapted to unroll from the roller tube from an opened position to a closed position. The roller tube assembly further comprises at least one cable cone secured to an end of the roller tube and comprising a lateral wall comprising a plurality of index slots disposed at radial intervals along the lateral wall. The roller shade also comprises at least one cable adapted to be wound about the cable cone, be tensioned by the tensioning assembly, and be attached to a free end of the shade material. The cable cone is adapted to be aligned with respect to the roller tube to an aligned position at which one of the index slots is substantially aligned with the at least one channel in the roller tube. An index insert is adapted to be inserted through the substantially aligned index slot and into the channel in the roller tube to lock the alignment between the roller tube and the cable cone.

21 Claims, 15 Drawing Sheets

(56) References Cited

U.S. PATENT DOCUMENTS

| | | | | |
|---|---|---|---|---|
| 5,280,818 | A | 1/1994 | Ubelhart | |
| 5,287,908 | A | 2/1994 | Hoffmann et al. | |
| 5,323,831 | A | 6/1994 | Manthei | |
| 5,351,742 | A | 10/1994 | Lichy | |
| 5,479,979 | A | 1/1996 | Hayashiguchi | |
| 5,535,806 | A | 7/1996 | Kold et al. | |
| 5,915,447 | A | 6/1999 | Lassen | |
| 6,119,758 | A | 9/2000 | Coenraets | |
| 6,206,076 | B1 | 3/2001 | Stawski | |
| 6,273,173 | B1 | 8/2001 | Lassen | |
| 6,497,267 | B1 * | 12/2002 | Azar | E06B 9/42 160/188 |
| 7,059,376 | B2 | 6/2006 | Tussinger | |
| 7,618,370 | B2 | 11/2009 | Choi et al. | |
| 7,665,502 | B2 | 2/2010 | Dekker | |
| 8,056,601 | B2 | 11/2011 | Kirby et al. | |
| 8,113,264 | B2 | 2/2012 | Kirby et al. | |
| 8,739,854 | B2 | 6/2014 | Mullet et al. | |
| 9,822,584 | B2 * | 11/2017 | Mullet | H01Q 1/50 |
| 10,337,243 | B2 * | 7/2019 | Berman | E06B 9/78 |
| 2014/0014281 | A1 | 1/2014 | Mullet et al. | |
| 2017/0006740 | A1 * | 1/2017 | Holt | E06B 9/72 |
| 2017/0167193 | A1 * | 6/2017 | Slivka | H02P 31/00 |
| 2018/0087319 | A1 * | 3/2018 | McPherson | E06B 9/581 |

* cited by examiner

SKYLIGHT ROLLER SHADE WITH A CABLE CONE INDEXING MECHANISM

BACKGROUND OF THE INVENTION

Technical Field

Aspects of the embodiments generally relate to roller shades, and more particularly to systems, methods, and modes for a skylight roller shade.

Background Art

Motorized roller shades provide a convenient one-touch control solution for screening windows, doors, or the like, to achieve privacy and thermal effects. A motorized roller shade typically includes a rectangular shade material attached at one end to a cylindrical rotating tube, called a roller tube, and at an opposite end to a hem bar. The shade material is wrapped around the roller tube. An electric motor, either mounted inside the roller tube or externally coupled to the roller tube, rotates the roller tube to unravel the shade material to cover a window.

In typical roller shades, the bottom end of the fabric is free hanging and will roll up and down perpendicular to the floor. To install a roller shade in a skylight or in a window that angles towards or out of a room, it is desirable to have the fabric hang and travel parallel to the window such that the fabric is sloped at the same angle as the window. It is also desirable to have the fabric not to sag, but be taught at all times—across the width and the roll-out length of the fabric—for any slope at which the skylight shade is attached. This is commonly achieved by tensioning the fabric with springs and pulley cables to guide it and having the fabric ride in side channels.

Typical skylight shades are difficult to assemble and install as they contain many parts, need to be customized to the window size, need to be perfectly aligned to a window, and need to be properly tensioned. While there are skylight shades available that are self-contained and pre-tensioned in a single frame, it becomes difficult to install such skylight shades in large skylight windows due to their size and weight. Typically more than one person is required to lift, align, and secure such a shade.

Therefore, a need has arisen for systems, methods, and modes for a skylight roller shade that can be easily customized to size, assembled, installed, and tensioned.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a skylight roller shade that can be easily customized to size, assembled, installed, and tensioned.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to an aspect of the embodiments, a roller shade adapted to adjustably cover a structural opening is provided. The roller shade comprises a pair of longitudinal side panel assemblies adapted to be attached at opposite sides of the structural opening and a roller tube assembly adapted to be attached to and between the pair of longitudinal side panel assemblies. Each side panel assembly comprises a tensioning assembly. The roller tube assembly comprises a roller tube comprising at least one channel; a shade material attached to the roller tube, wherein the shade material is adapted to unroll from the roller tube from an opened position to a closed position; at least one cable cone secured to an end of the roller tube and comprising a lateral wall comprising a plurality of index slots disposed at radial intervals along the lateral wall; at least one index insert; and at least one cable. The cable is adapted to be wound about the cable cone, be tensioned by the tensioning assembly, and be attached to a free end of the shade material. The cable cone is adapted to be aligned with respect to the roller tube to an aligned position at which one of the index slots is substantially aligned with the at least one channel in the roller tube. The index insert is adapted to be inserted through the substantially aligned index slot and into the channel in the roller tube to lock the alignment between the roller tube and the cable cone.

According to an embodiment, the aligned position is a position at which a start point, at which the cable starts rolling onto the cable cone, is positioned substantially opposite an open position roll off point, at which the shade material rolls off the roller tube when the roller shade is at the opened position. According to an embodiment, the cable cone comprises a hole into which a terminal end of a respective cable is inserted and anchored, wherein the hole corresponds to the start point. The cable cone may further comprise a through bore, wherein the cable cone is adapted to slide onto the end of the roller tube. The lateral wall may comprise a circumferential wall extending from an inner surface of the bore inside the cable cone.

According to an embodiment, the at least one channel longitudinally extends and recessed in an outer surface of the roller tube. The at least one channel may be further adapted to secure the shade material to the roller tube.

According to an embodiment, the cable cone comprises a helical groove, wherein the cable is adapted to wound on the helical groove of the cable cone. According to an embodiment, the index insert comprises a projection adapted to pressure fit the index insert into the aligned index slot. According to an embodiment, the roller tube assembly further comprises a motor drive unit and an idler attached at opposite ends of the roller tube, wherein one of the motor drive unit and the idler comprises a flange adapted to abut the lateral wall of the cable cone to secure the cable cone and the index insert to the roller tube.

According to an embodiment, at least one tensioning assembly comprises a fixed pulley bracket comprising a first and second pulleys; a floating pulley bracket comprising a third pulley; and a spring attached at one end to the floating pulley bracket; wherein the cable is looped through the first, second, and third pulleys of the tensioning assembly. According to an embodiment, the roller tube assembly further comprises a shade drive unit adapted to rotate the roller tube to unroll or roll the shade material to adjustably cover or uncover the structural opening. The shade drive unit may comprise a motor.

According to an embodiment, the roller tube assembly further comprises a hem bar attached to the free end of the shade material, and wherein the cable is attached to the hem bar. The hem bar may comprise wheels extending from opposite ends of the hem bar, wherein each side panel assembly comprises a longitudinal hem bar channel adapted to receive at least one of the wheels to guide the hem bar along the side panel assembly. Each hem bar channel comprises a longitudinal lateral wall upon which the at least one wheel rolls.

According to another aspect of the embodiments, a roller shade adapted to adjustably cover a structural opening is provided. The roller shade comprise a pair of longitudinal side panel assemblies adapted to be attached at opposite sides of the structural opening, wherein each side panel assembly comprises a tensioning assembly. The roller shade also comprises a roller tube assembly adapted to be attached to and between the pair of longitudinal side panel assemblies. The roller tube assembly comprises: a roller tube comprising a channel; a shade material attached to the roller tube, wherein the shade material unrolls from the roller tube from an opened position to a closed position; a pair of cable cones attached at opposite ends of the roller tube, wherein each cable cone comprises a lateral wall comprising a plurality of index slots disposed at radial intervals along the lateral wall; a pair of cables; and a pair of index inserts. The cables are adapted to be wound about respective cable cones, be tensioned by respective tensioning assemblies, and be attached to a free end of the shade material. Each cable cone is adapted to be aligned with respect to the roller tube to an aligned position at which a start point, at which the cable starts rolling onto the cable cone, is positioned substantially opposite an open position roll off point, at which the shade material rolls off the roller tube when the roller shade is at the opened position, wherein at the aligned position at least one index slot is substantially aligned with the channel in the roller tube. The index insert is adapted to be inserted through the substantially aligned index slot and into the longitudinal channel to lock the alignment between the roller tube and the cable cone.

According to another aspect of the embodiments, a method if provided for assembling a roller shade comprising a roller tube assembly having a shade material adapted to adjustably cover a structural opening and a pair of longitudinal side panel assemblies adapted to be attached at opposite sides of the structural opening and each having tensioning assemblies adapted to tension the shade material. The method comprises: attaching the shade material to a roller tube, wherein the roller tube comprises a channel; rolling the shade material onto the roller tube until reaching an opened position where the shade material is substantially rolled onto the roller tube; aligning at least one cable cone with respect to an end of the roller tube to an aligned position, wherein the cable cone comprises a lateral wall comprising a plurality of index slots disposed at radial intervals along the lateral wall, where at the aligned position one of the index slots is substantially aligned with the channel in the roller tube; inserting an index insert through the substantially aligned index slot and into the channel in the roller tube to lock the alignment between the roller tube and the cable cone; and attaching a cable to the at least one cable cone, wherein the cable is adapted to be wound about the cable cone, be tensioned by the tensioning assembly, and be attached to a free end of the shade material. The aligned position is a position at which a start point, at which the cable starts rolling onto the cable cone, is positioned substantially opposite an open position roll off point, at which the shade material rolls off the roller tube when the roller shade is at the opened position. The cable cone comprises a through bore, wherein the method further comprises a step of sliding the cable cone onto the roller tube after aligning the cable cone with the roller tube. The roller tube assembly further comprises a motor drive unit and an idler, wherein one of the motor drive unit and the idler slot comprises a flange, wherein the method further comprises the step of inserting one of the motor drive unit and the idler into the roller tube until the flange abuts the lateral wall of the cable cone to secure the cable cone and the index insert to the roller tube.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWING

Figure 1:
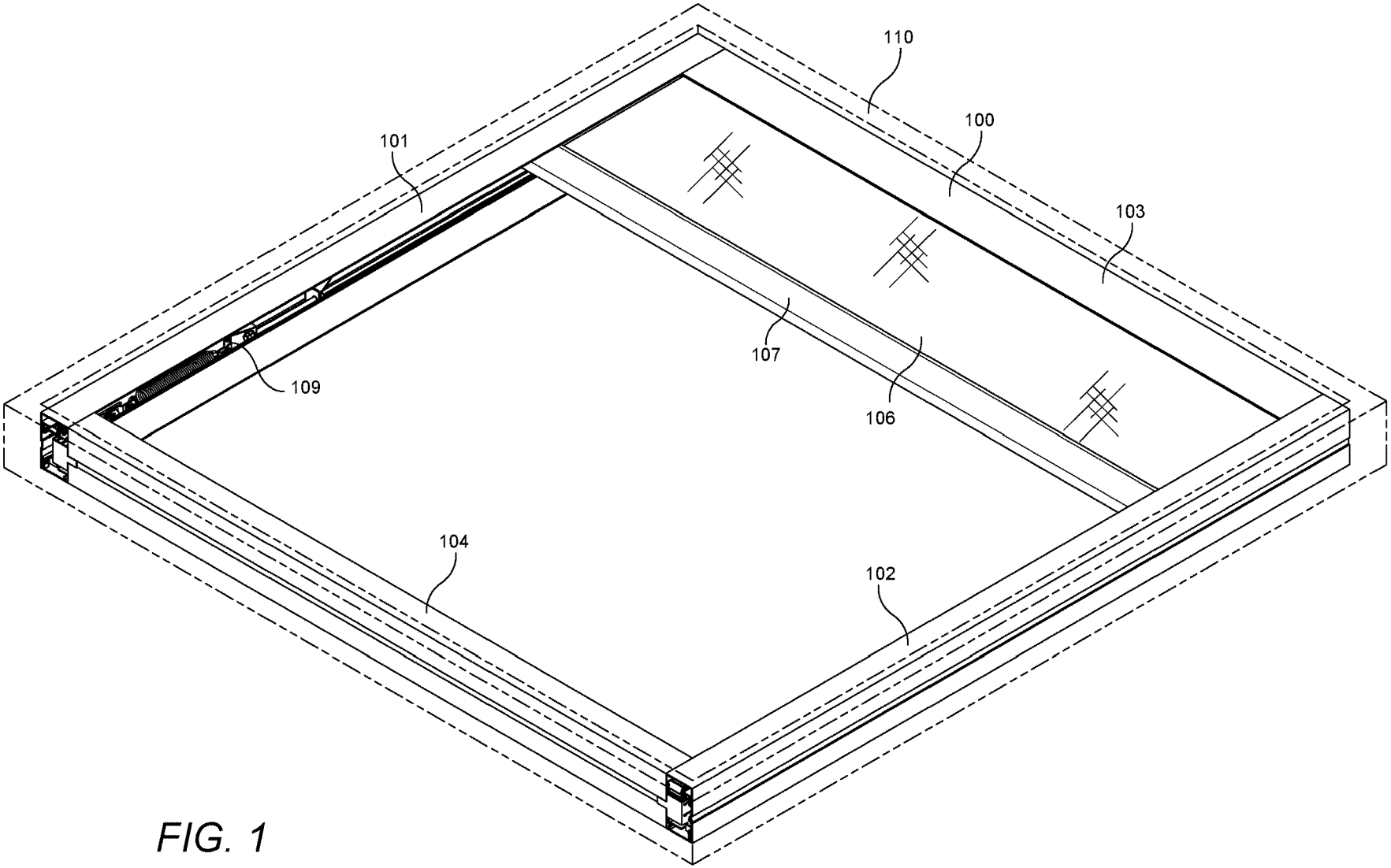

FIG. 1 illustrates a top perspective view of a skylight roller shade installed inside a window frame according to one aspect of the embodiments.

Figure 2:
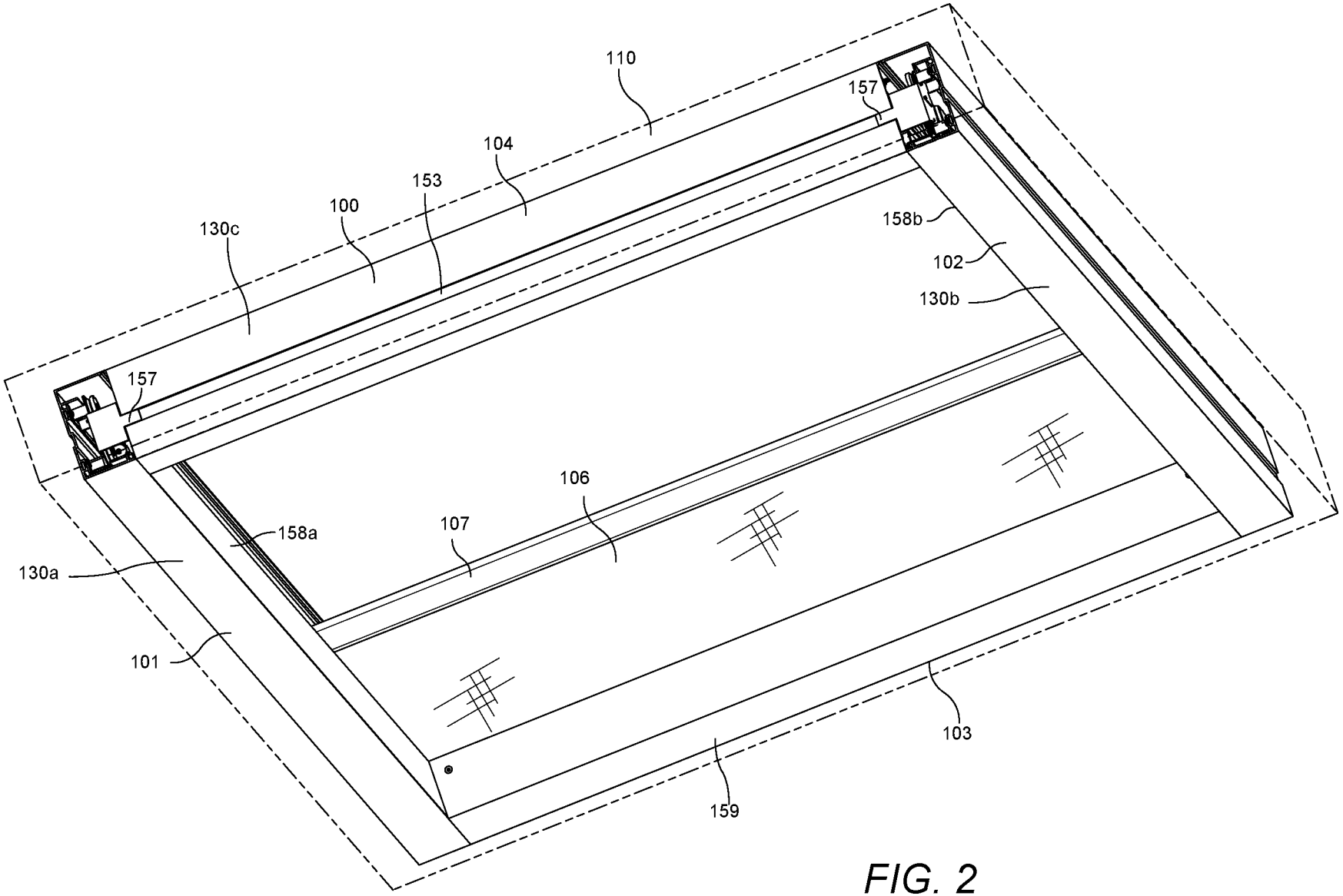

FIG. 2 illustrates a bottom perspective view of a skylight roller shade installed inside a window frame according to one aspect of the embodiments.

Figure 3:
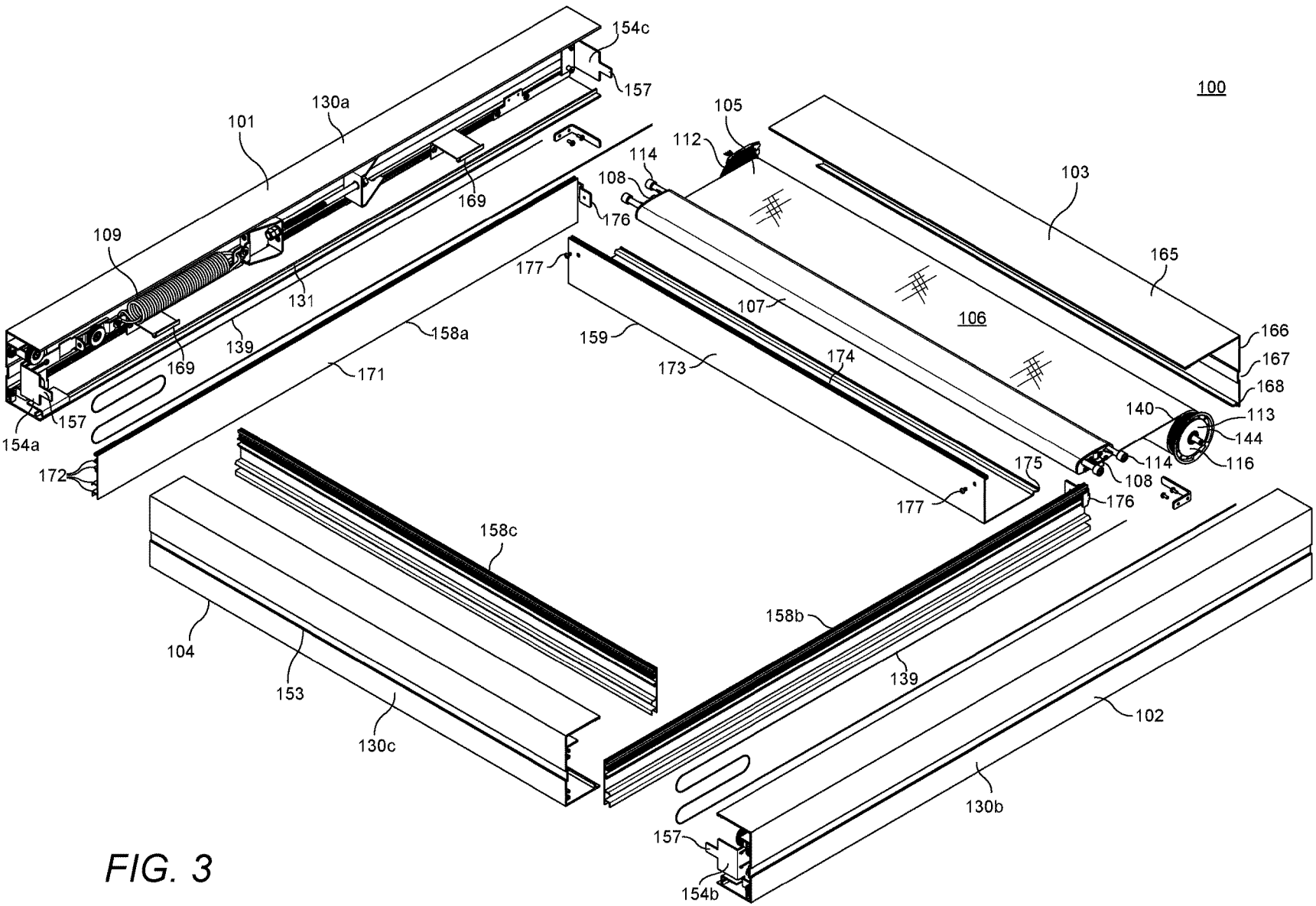

FIG. 3 illustrates a top perspective view of a disassembled skylight roller shade according to one aspect of the embodiments.

Figure 4:
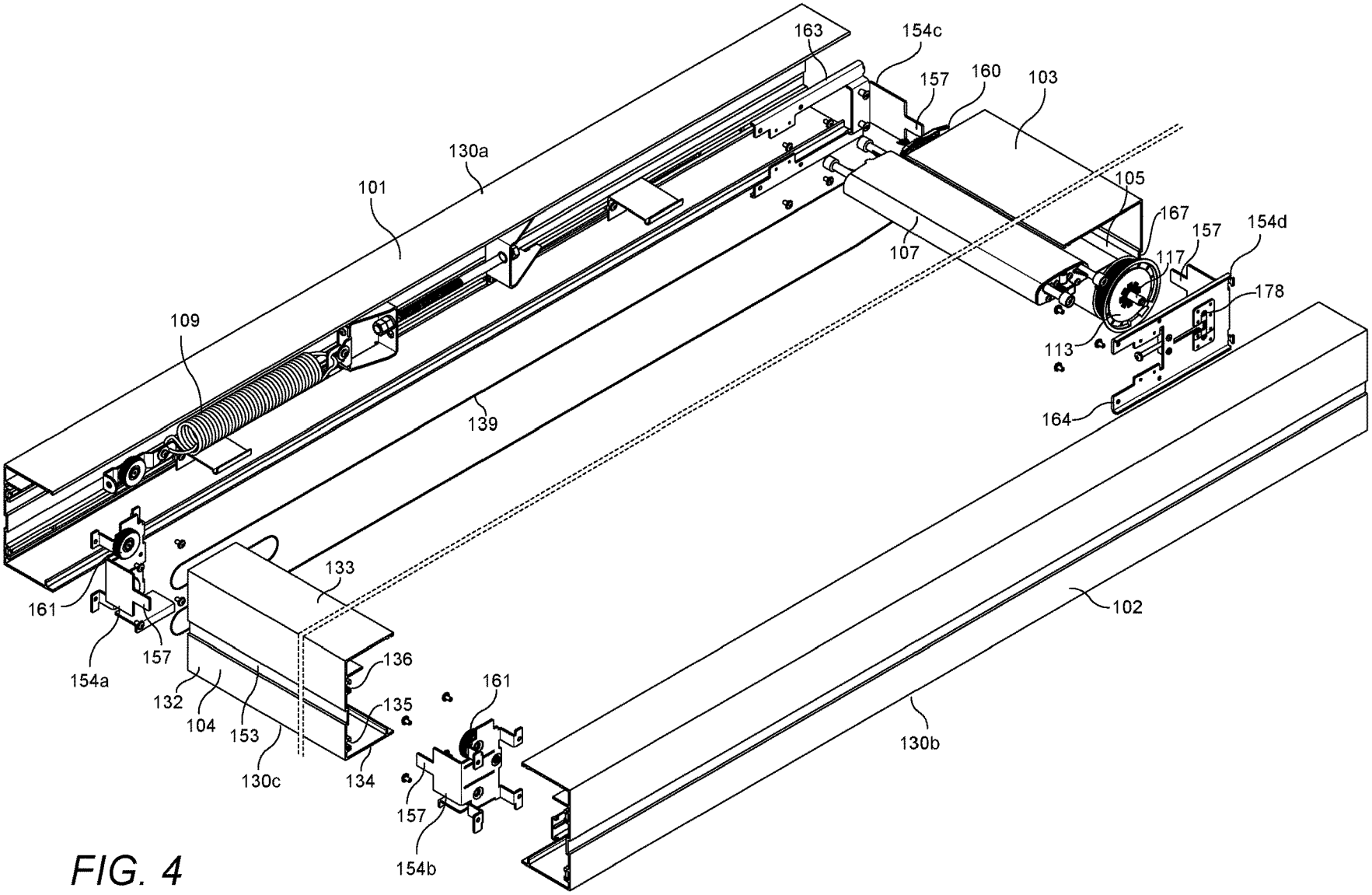

FIG. 4 illustrates a partially exploded top perspective view of the skylight roller shade showing the components of the alignment feature according to one aspect of the embodiments.

Figure 5:
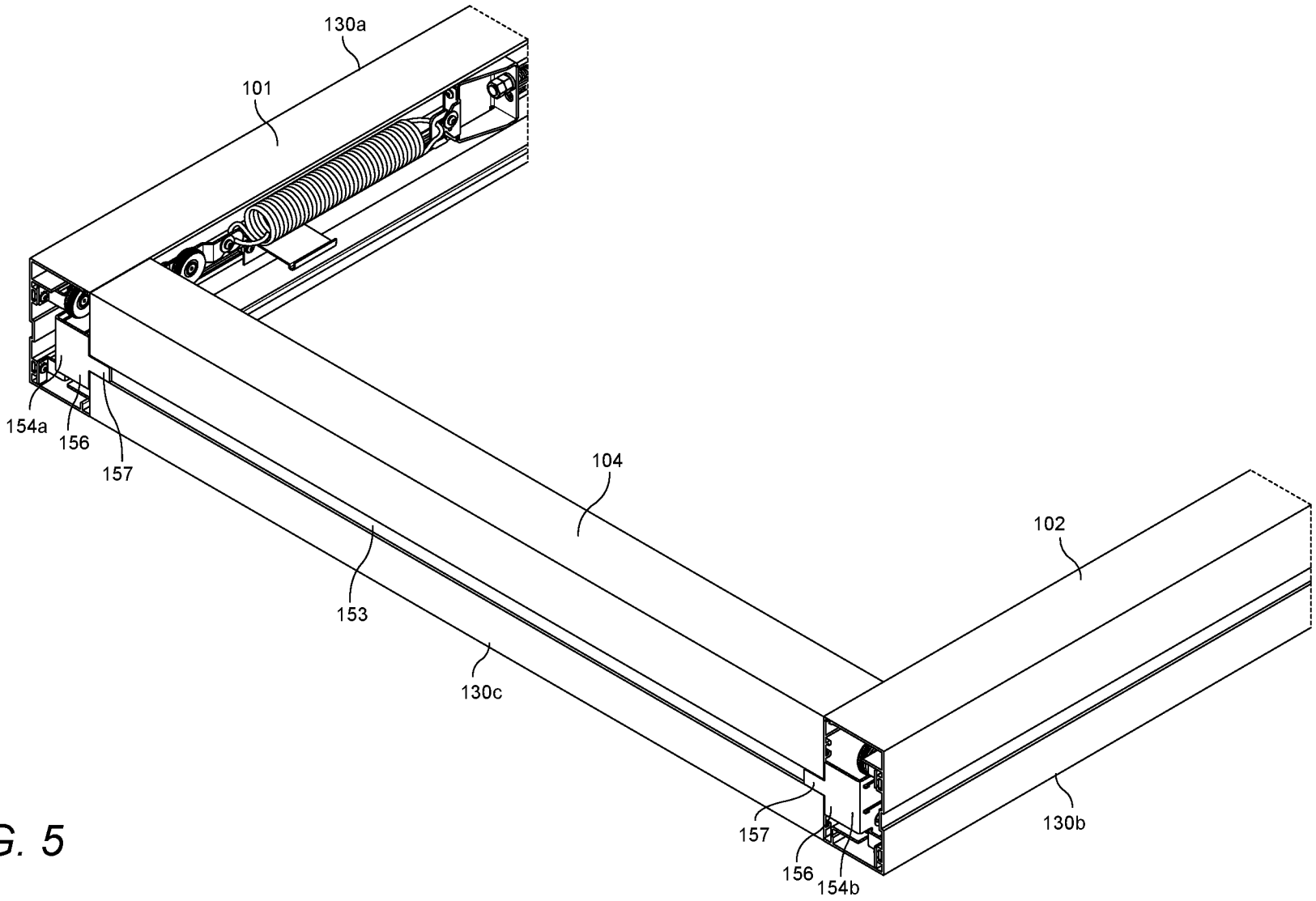

FIG. 5 illustrates a top perspective view of a portion of an assembled skylight roller shade showing the components of the alignment feature according to one aspect of the embodiments.

Figure 6:
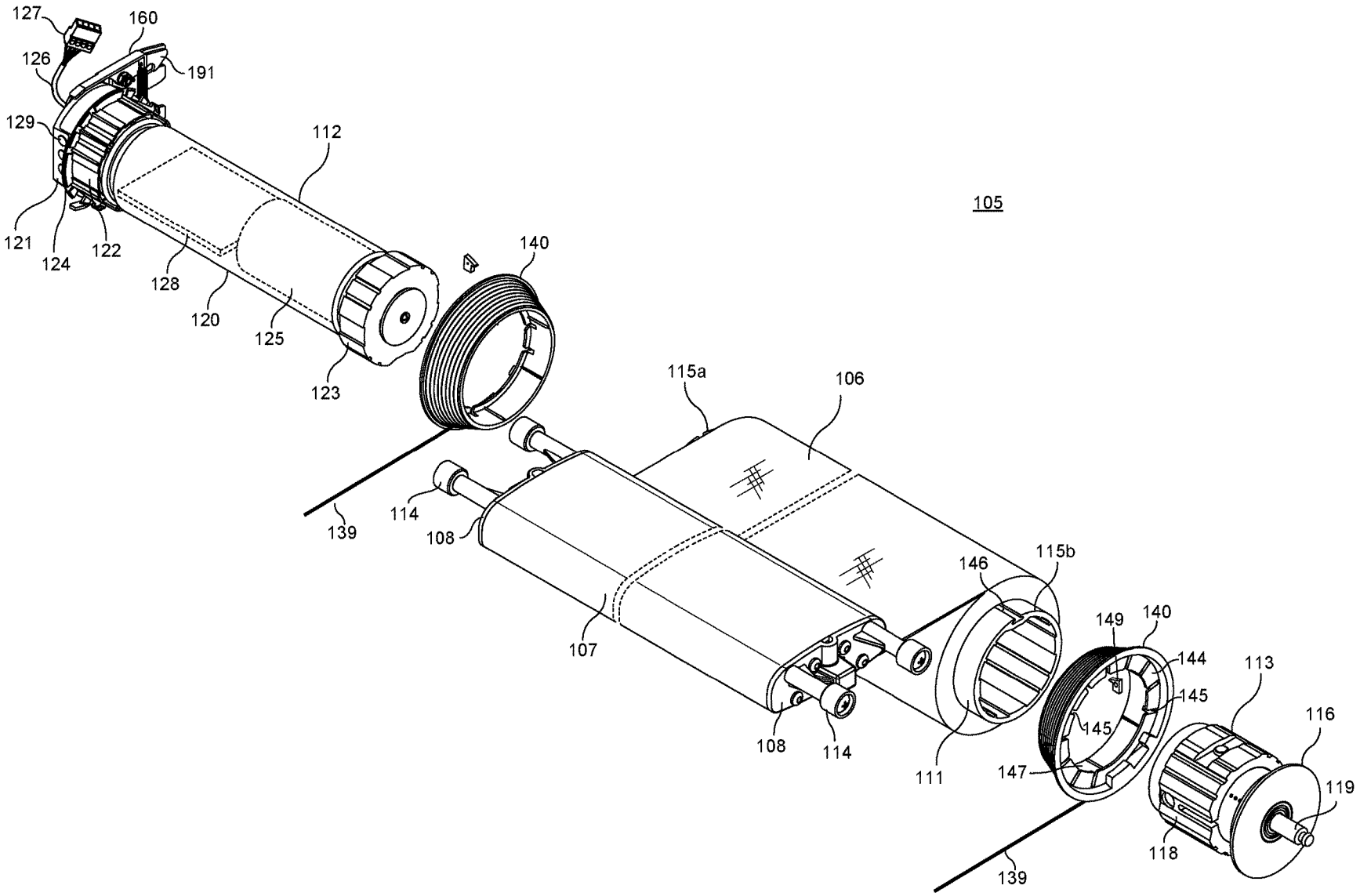

FIG. 6 illustrates an exploded perspective view of the roller shade tube assembly according to one aspect of the embodiments.

Figure 7A:
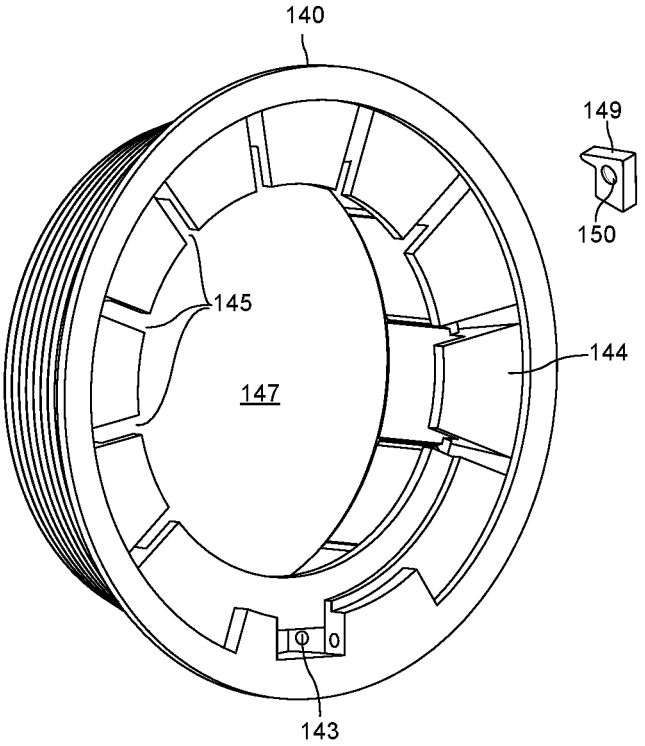

FIG. 7A illustrates a side perspective view of a cable cone according to one aspect of the embodiments.

Figure 7B:
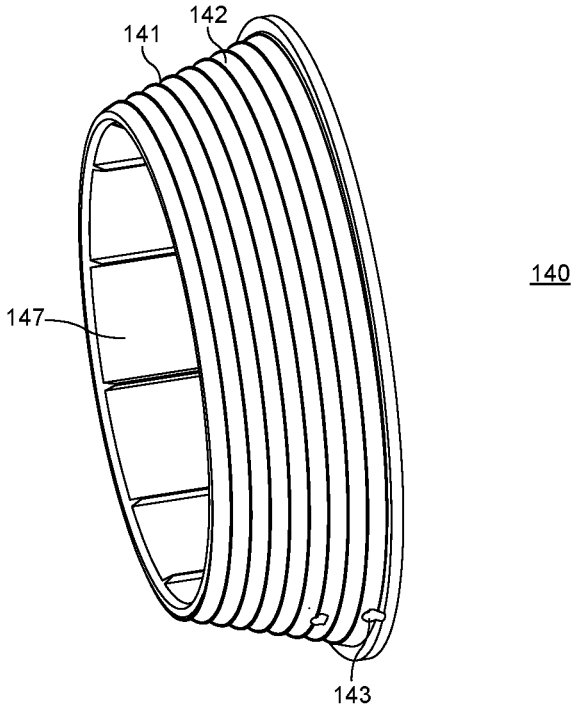

FIG. 7B illustrates a front perspective view of the cable cone according to one aspect of the embodiments.

Figure 8:
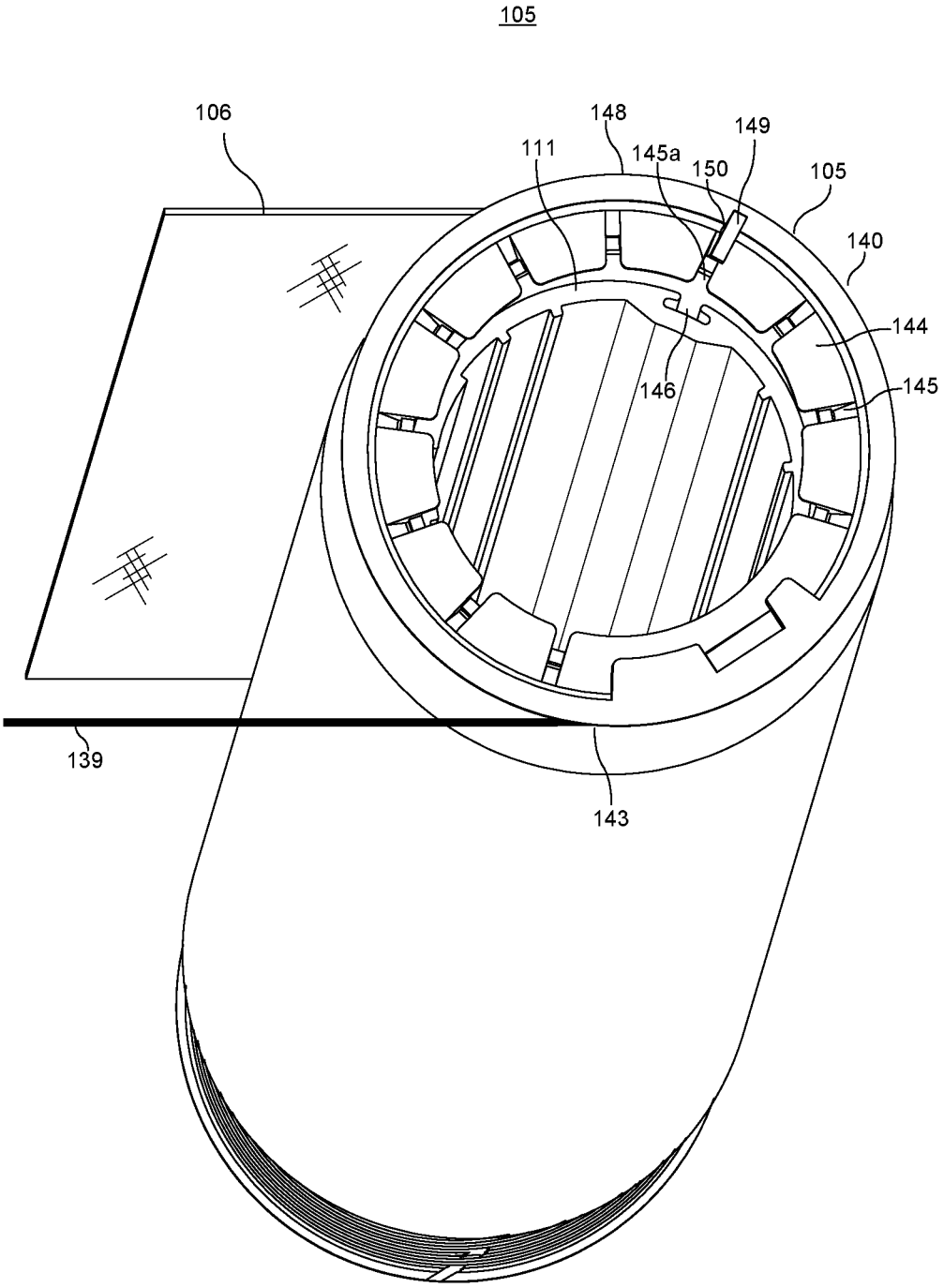

FIG. 8 illustrates a side perspective view of the roller tube assembly illustrating the cone indexing feature according to one aspect of the embodiments.

Figure 9:
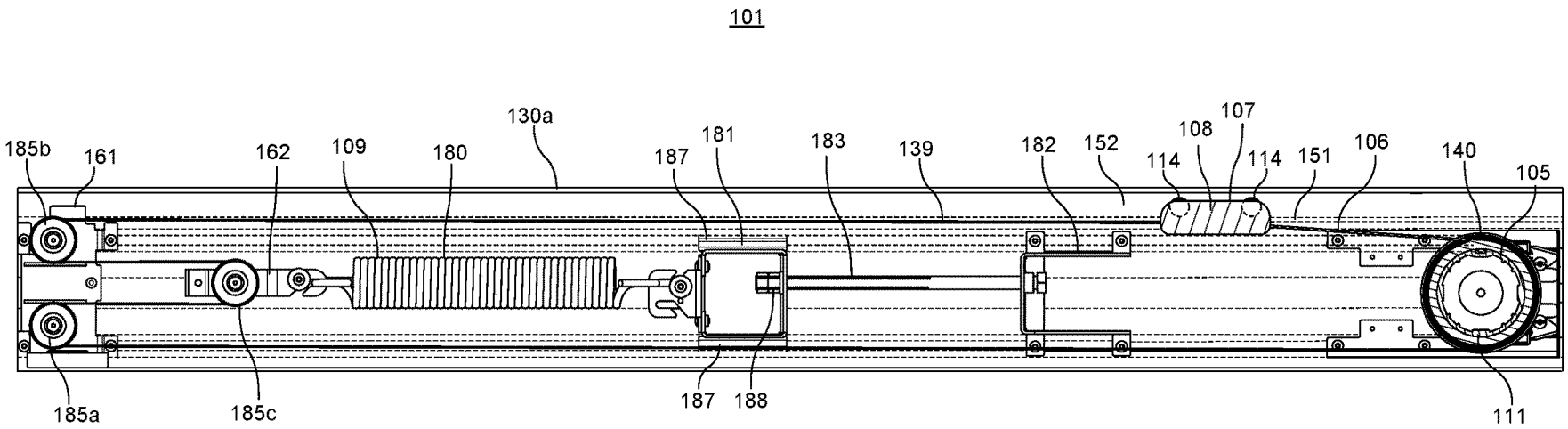

FIG. 9 illustrates an elevational inner view of a side panel assembly according to one aspect of the embodiments.

Figure 10:
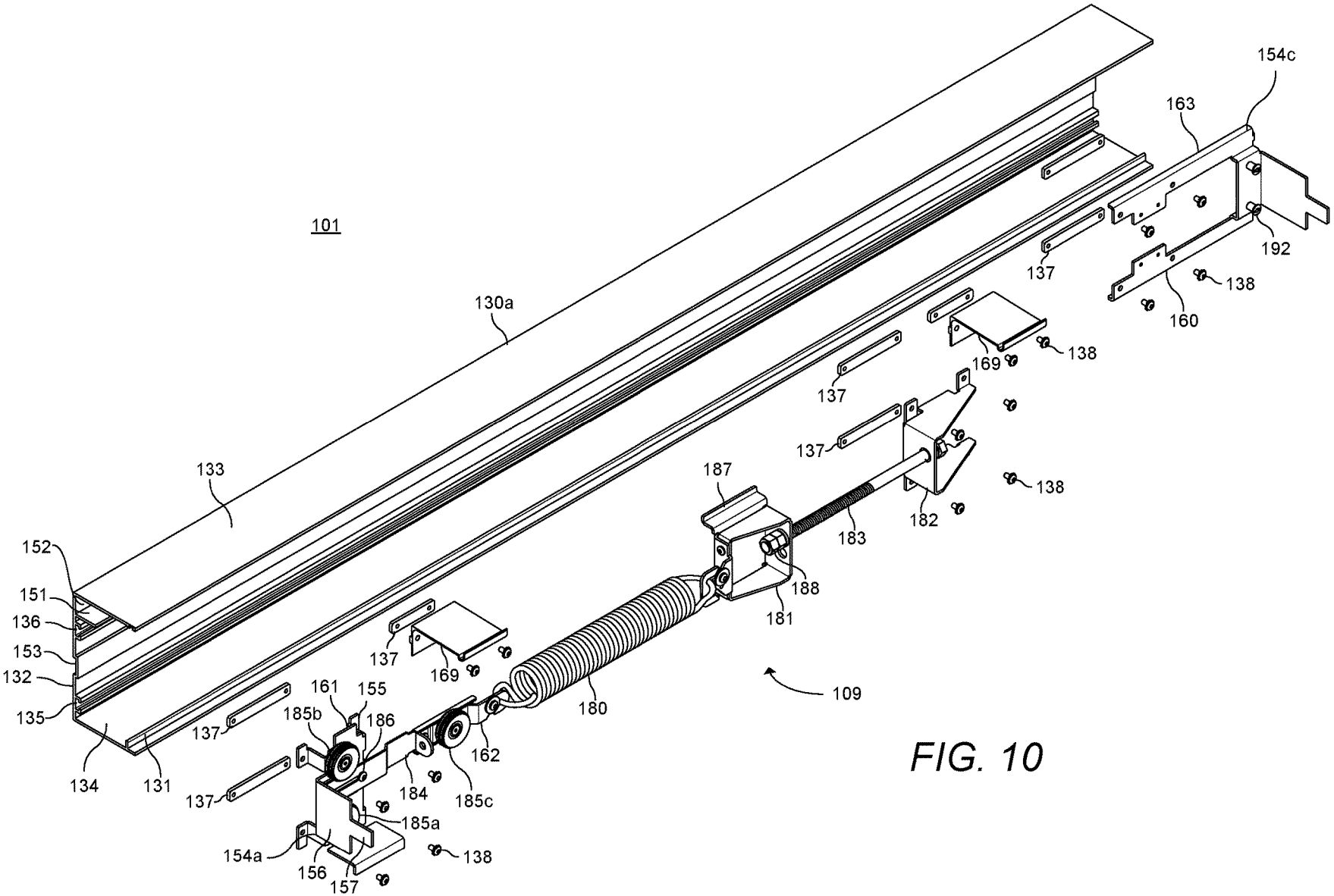

FIG. 10 illustrates an exploded perspective view of a first side panel assembly according to one aspect of the embodiments.

Figure 11:
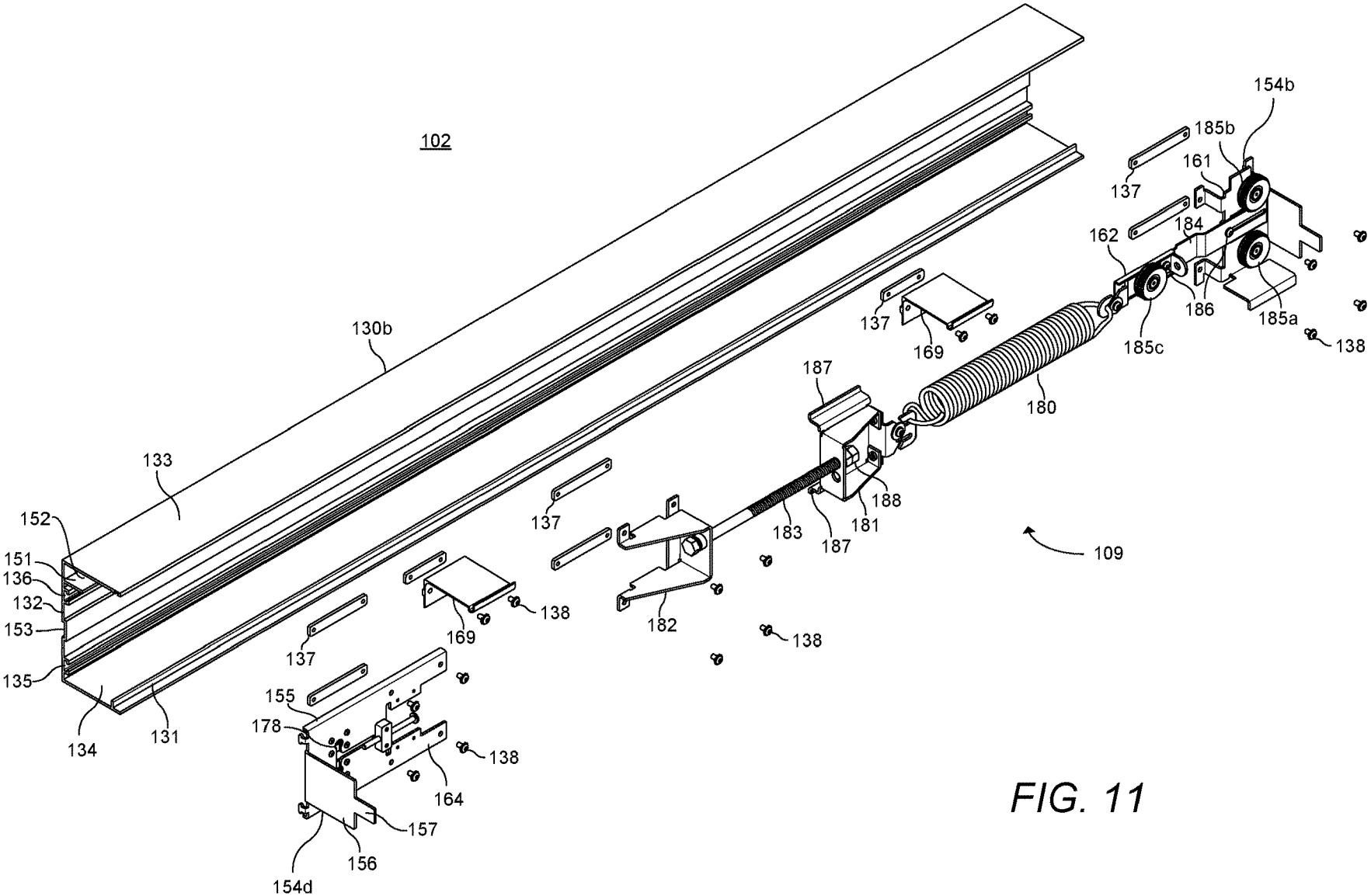

FIG. 11 illustrates an exploded perspective view of a second side panel assembly according to one aspect of the embodiments.

Figure 12:
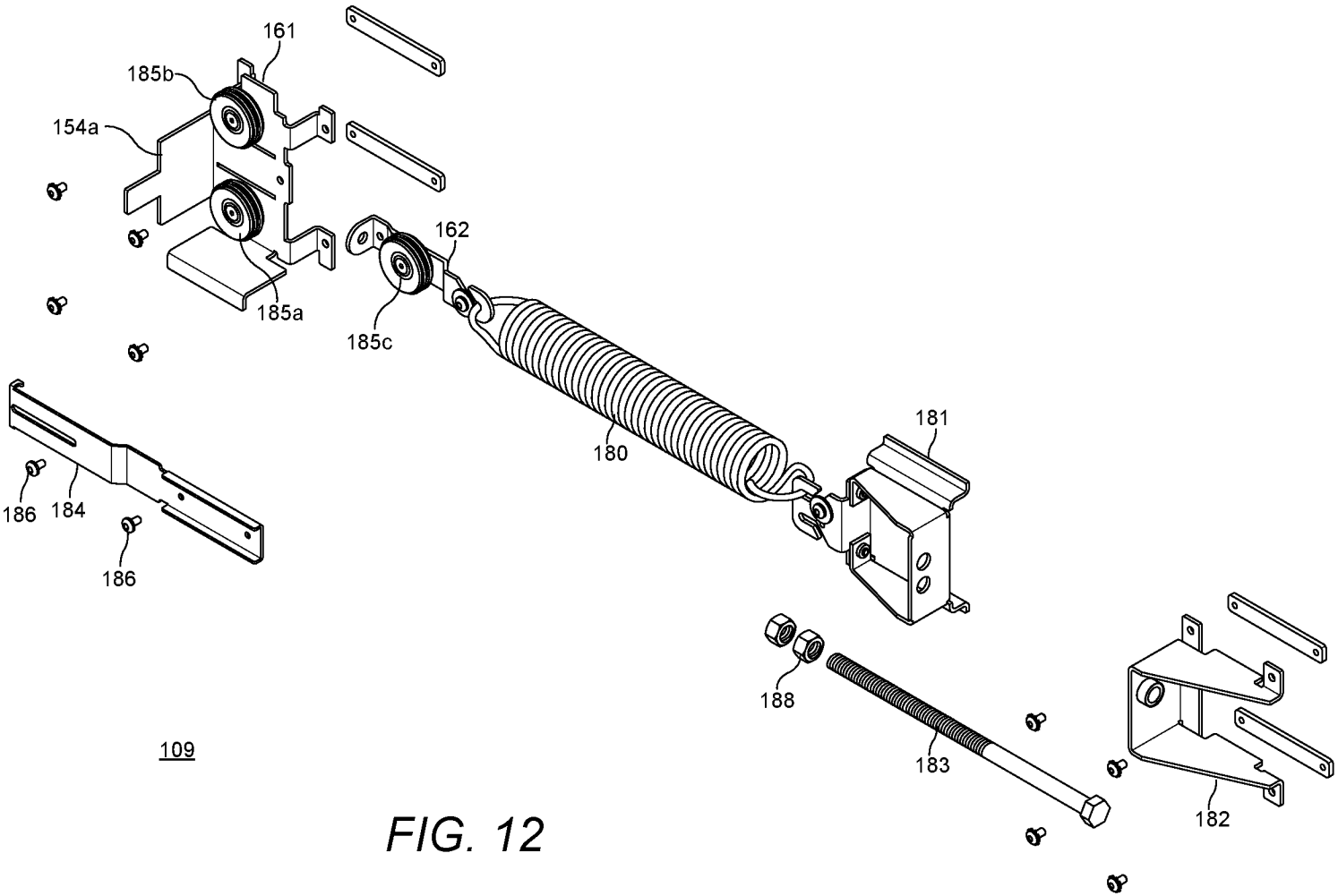

FIG. 12 illustrates an exploded perspective view of a tensioning assembly according to one aspect of the embodiments.

Figure 13A:
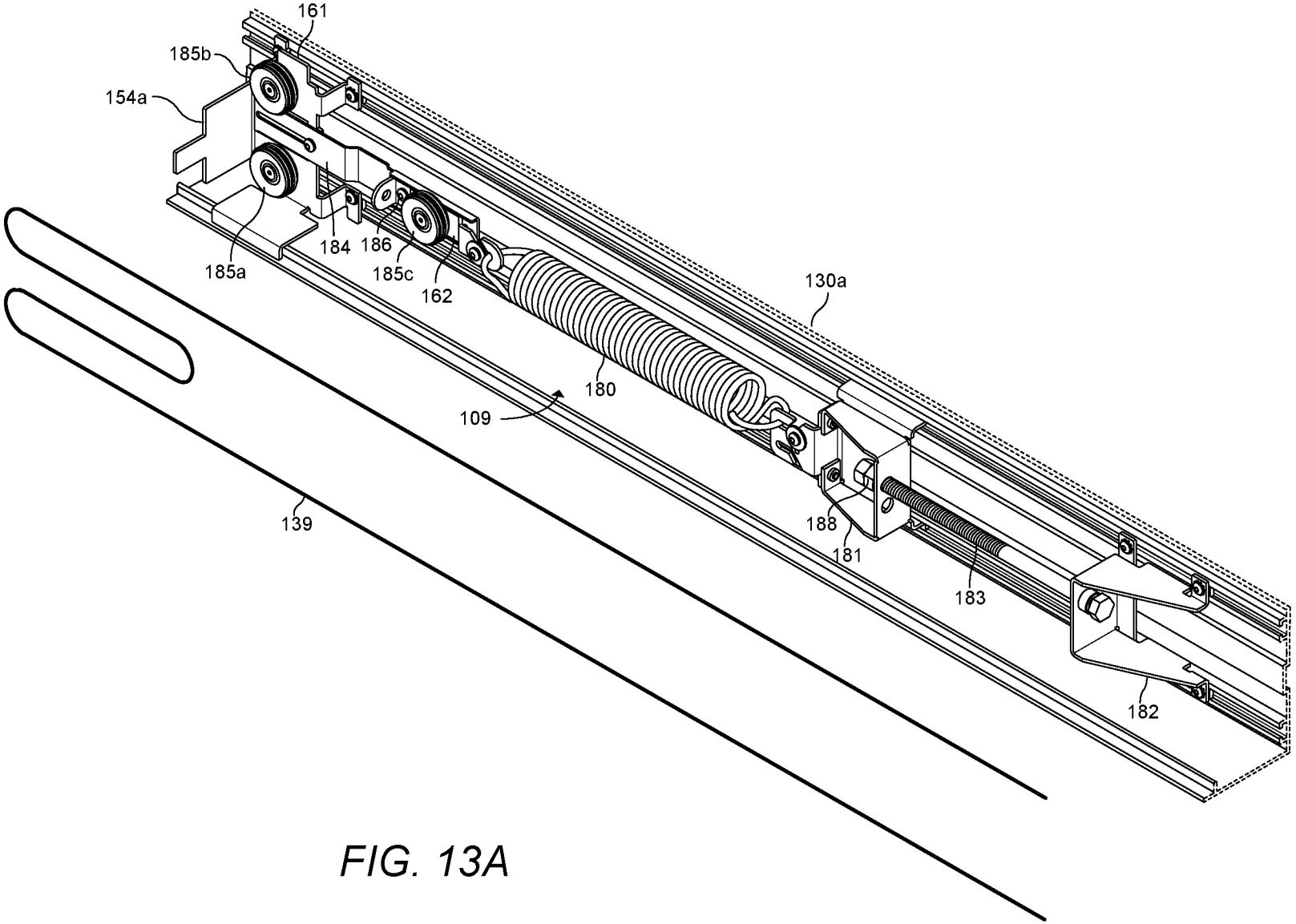

FIG. 13A illustrates a perspective view of a portion of a side panel assembly showing the tensioning assembly with the cord removed and the tensioning assist bracket attached according to one aspect of the embodiments.

Figure 13B:
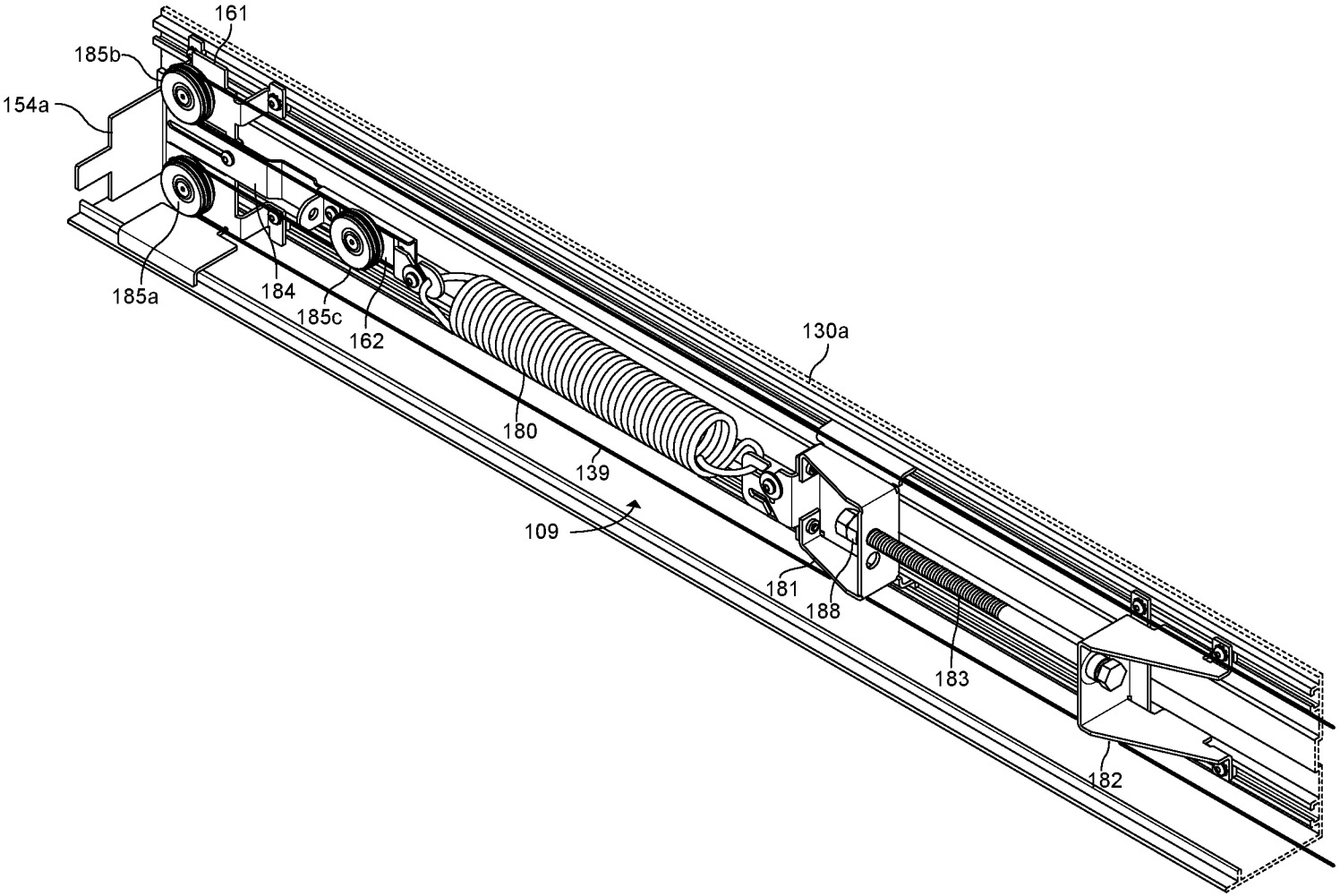

FIG. 13B illustrates a perspective view of a portion of a side panel assembly showing the tensioning assembly with the cord and the tensioning assist bracket attached according to one aspect of the embodiments.

Figure 13C:
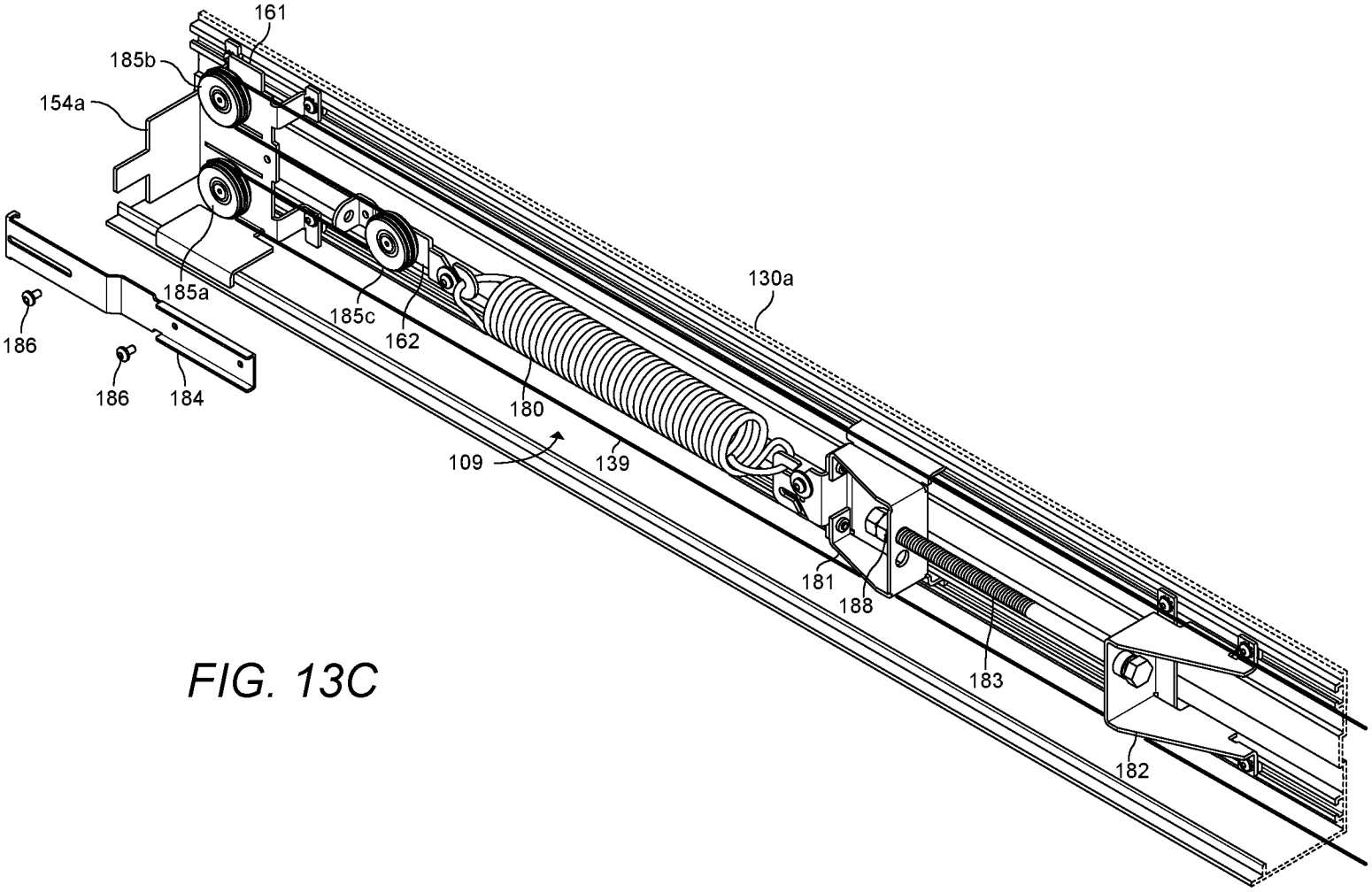

FIG. 13C illustrates a perspective view of a portion of a side panel assembly showing the tensioning assembly with the cord attached and the tensioning assist bracket removed according to one aspect of the embodiments.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Skylight Roller Shade
101 First Side Panel Assembly
102 Second Side Panel Assembly
103 Head Panel
104 Base Panel Assembly
105 Roller Tube Assembly
106 Shade Material
107 Hem Bar
108 Endcap
109 Tensioning Assembly
110 Window Frame
111 Roller Tube
112 Motor Drive Unit
113 Idler
114 Wheel
115*a* First End
115*b* Second End
116 Flange
118 Idler Body
119 Idler Pin
120 Motor Housing
121 Motor Head
122 Crown Adapted Wheel
123 Drive Wheel
124 Flange
125 Motor
126 Power Cord
127 Terminal Block
128 Motor Control Module
129 User Interface
130*a-b* Side Channels
130*c* Base Channel
131 Lateral Wall
132 Side Wall
133 Top Wall
134 Bottom Wall
135 First Longitudinal Track
136 Second Longitudinal Track
137 Back Plate
138 Screw
139 Cable
140 Cable Cone
141 Outer Surface
142 Helical Groove
143 Cable Hole
144 Circumferential Lateral Wall
145 Index Slot
145*a* Aligned Index Slot
146 Longitudinal Channel
147 Bore
148 Open Position Roll Off Point
149 Index Insert
150 Projection
151 Lateral Wall
152 Hem Bar Channel
153 Alignment Channel
154*a-d* First Through Fourth Corner Brackets
155 First Portion of Corner Bracket
156 Second Portion of Corner Bracket
157 Alignment Tab
158*a* First Side Fascia Section
158*b* Second Side Fascia Section
158*c* Base Fascia Section
159 Head Fascia Section
160 Motor Latch Bracket
161 Fixed Pulley Bracket
162 Floating Pulley Bracket
163 Motor Bracket
164 Idle Bracket
165 Top Wall
166 Side Wall
167 Alignment Channel
168 Lateral Wall
169 Fascia Clip
171 Side Wall
172 Lateral Wall
173 Side Wall
174 Bottom Wall
175 Hook Shaped Wall

176 Fascia Corner Bracket
177 Screws
178 Keyhole
180 Spring
181 Traveler Tension Bracket
182 Anchor Tension Bracket
183 Threaded Bolt
184 Tension Assist Bracket
185*a-c* First Through Third Pulley Wheels
186 Screw
187 Arm
188 Nut
191 Arms
192 Pins

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of a skylight roller shade, but is not limited thereto, except as may be set forth expressly in the appended claims. While the roller shade is described herein for covering a skylight, the roller shade may be used to cover other types of windows, as well as doors, wall openings, or the like. The embodiments described herein may further be adapted in other types of window or door coverings, such as inverted rollers, Roman shades, Austrian shades, pleated shades, blinds, shutters, skylight shades, garage doors, or the like.

Disclosed herein are systems, methods, and modes for a skylight roller shade that can be easily customized to size, assembled, installed, and tensioned. Beneficially, the skylight roller shade of the present embodiments can be easily customized to fit any sized window frame by using components that can be cut and assembled to size as described in more detail below. The design of the skylight roller shade of the present embodiments also allows it to be easily installed and tensioned in the field by a single installer.

Referring to FIGS. 1, 2, and 3 there is shown a skylight roller shade 100 according to one embodiment. Specifically, FIG. 1 illustrates a top perspective view of the skylight roller shade 100 installed inside a window frame 110, FIG. 2 illustrates a bottom perspective view of the skylight roller shade 100 installed inside the window frame 110, and FIG. 3 illustrates a disassembled top perspective view of the skylight roller shade 100. Roller shade 100 generally comprises a roller tube assembly 105 from which shade material 106 unrolls and first and second side panel assemblies 101 and 102 between the roller tube assembly 105 is installed. The roller shade 100 may further comprise a head panel 103 and base panel assembly 104. Although in other embodiments, the head panel 103 and/or the base panel assembly 104 may not be used. The skylight roller shade 100 is adapted to be mounted inside a window frame 110 such as a skylight as discussed below. However, the skylight roller shade 100 may also be mounted in an outside mount configuration by mounting it to and below the window frame 110.

Referring to FIG. 6, there is shown an exploded perspective view of the roller shade tube assembly 105. The roller tube assembly 105 generally comprises a roller tube 111, a motor drive unit 112, an idler 113, a pair of cable cones 140, a pair of cables 139, shade material 106, and a hem bar 107. One end of the shade material 106 is connected to the roller tube 111 and the other end is connected to the hem bar 107. Shade material 106 wraps around the roller tube 111 and is unrolled from the roller tube 111 to cover a window, a door, a wall opening, or the like. In various embodiments, shade material 106 comprises fabric, plastic, vinyl, or other materials known to those skilled in the art. Roller tube 111 is generally cylindrical in shape and longitudinally extends from a first end 115*a* to a second end 115*b*. In various embodiments, the roller tube 111 comprises aluminum, stainless steel, plastic, fiberglass, or other materials known to those skilled in the art. The roller tube 111 comprises a longitudinal channel 146 recessed in its outer surface. The channel 146 may be used to secure the shade material 106 to the roller tube 111. The hem bar 107 is attached to and longitudinally extends along the free end of the shade material 106. The hem bar 107 comprises a pair of endcaps 108 secured to the terminal ends of the hem bar 107. Each endcap 108 may comprise a pair of wheels 114 laterally extending from the endcap 108.

The first end 115*a* of the roller tube 111 receives the motor drive unit 112, and the second end 115*b* receives the idler 113. The idler 113 may comprise an idler pin 119 rotatably connected about an idler body 118. The idler body 118 is inserted into the roller tube 111 and is operably connected to the roller tube 111 such that rotation of the roller tube 111 also rotates the idler body 118. The idler body 118 comprises a flange 116 to prevent the idler body 118 from sliding entirely into the roller tube 111. The idler body 118 may comprise ball bearings therein (not shown) allowing the idler body 118, and thereby the roller tube 111, rotate with respect to the idler pin 119.

The motor drive unit 112 may comprise a motor head 121, a crown adapter wheel 122, a motor housing 120 containing a motor control module 128 and motor 125 therein, and a drive wheel 123. The motor head 121 is adapted to be connected to a motor latch bracket 160. The crown adapter wheel 122 and drive wheel 123 are generally cylindrical in shape and are inserted into and operably connected to roller tube 111 at its first end 115*a*. Crown adapter wheel 122 and drive wheel 123 may comprise a plurality of channels extending circumferentially about their external surfaces that mate with complementary projections radially extending from an inner surface of roller tube 111 such that crown adapter wheel 122, drive wheel 123, and roller tube 111 rotate together during operation. Crown adapter wheel 122 can further comprise a flange 124 radially extending therefrom to prevent the crown adapter wheel 122 from sliding entirely into the roller tube 111 and maintain the motor head 121 exterior to the roller tube 111. The crown adapter wheel 122 may be rotatably attached to a first end of the motor housing 120 via ball bearings therein (not shown). The crown adapter wheel 122 is adapted to removably and releasably couple the motor drive unit 112 to the roller tube 111. The drive wheel 123 is operably connected to the output shaft of the motor 125 such that rotation of the motor output shaft also rotates the drive wheel 123. The motor 125 may comprise a brushless direct current (BLDC) electric motor.

In another embodiment, the motor 125 comprises a brushed DC motor, or any other motor known in the art. The motor drive unit 112 may comprise similar configuration to the CSM-QMTDC-163-1 series motors, available from Crestron Electronics, Inc. of Rockleigh, N.J. The Crestron® CSM-QMTDC-163-1 series motors utilizes the quiet, precision-controlled Quiet Motor Technology to control the movement of the shade, keep track of the shade's position, and adjust the shade to the user's desired preset positions.

In operation, the shade material 106 is rolled and unrolled from the roller tube 111 via the roller shade drive unit 112 to open or close the window. Particularly, the motor 125 drives the drive wheel 123, which in turn engages and rotates the roller tube 111. The roller tube 111, in turn, engages and rotates the crown adapter wheel 122 and idler body 118 with respect to the motor 125, while the motor housing 120, including the motor 125 and motor control module 128, remain stationary. As a result, the shade material 106 may be unrolled from an opened position, when substantially the entire shade material 106 is wrapped about the roller tube 111, to a closed position, when the shade material 106 is substantially unraveled, and vice versa.

The motor control module 128 operates to control the motor 125, directing the operation of the motor 125, including its direction, speed, and position. The motor control module 128 may comprise fully integrated electronics. It can comprise a controller, a memory, and a wired or wireless communication interface. The motor controller can comprise a processor adapted to execute an operating system, run various applications, and/or provide processing, for example to process various commands and perform operations, such as controlling the direction, position, and speed of the motor 125. The communication interface is configured for receiving control commands from an external control point.

The motor drive unit 112 can further comprise a local user interface 129, such as a three-button interface, configured for enabling configuration of the motor drive unit 112 as well as receiving control commands directly from a user. Furthermore, the motor control module 112 may comprise a light indicator (not shown), such as a multicolor light emitting diode (LED), to provide feedback as to the status of the roller shade 100. Control commands received by the motor control module 128 may be a direct user input from the user interface 129 or a wired or wireless signal from an external control point. For example, the controller may receive a control command from a wall-mounted button panel or a touch-panel in response to a button actuation or similar action by the user. Control commands may also originate from a signal generator such as a timer or a sensor.

Power can be supplied to the motor drive unit 112 through a power cord 126 by connecting a terminal block 127 to a dedicated power supply (not shown), such as the CSA-PWS40 or CSA-PWS10SHUB-ENET power supplies, available from Crestron Electronics, Inc. of Rockleigh, N.J. In another embodiment, the motor drive unit 112 may be battery operated and as such may be connected to an internal or external power supply in a form of batteries. In yet another embodiment, the motor drive unit 112 may be powered via solar panels placed in proximity to the window to aggregate solar energy.

Referring to FIGS. 6 and 7A-7B, roller tube assembly 105 further comprises cable cones 140, where FIG. 7A illustrates a side perspective view of a cable cone 140 and FIG. 7B illustrates a front perspective view of the cable cone 140. Each cable cone 140 comprises a through bore 147 sized such that the cones 140 can fit over the opposite terminal ends 115*a-b* of the roller tube 111. Each cable cone 140 comprises a cone shaped outer surface 141 having a helical groove 142. Each cone 140 further comprises a hole 143 proximate to its wider end into which a terminal end of a tensioning cable 139 is inserted and anchored. Each tensioning cable 139 is adapted to be wound up on the helical groove 142 of each cable cone 140. Each cable cone 140 further comprises a circumferential lateral wall 144 extending from an inner surface of the bore 147 inside the cable cone 140. The lateral wall 144 comprises a plurality of index slots 145 disposed at radial intervals along the lateral wall 144.

During assembly of the roller tube assembly 105, the design of each cable cone 140 allows the cone 140 to be indexed into a correct position with respect to the roller tube 111. One terminal end of the shade material 106 is first attached to the longitudinal channel 146 and the other terminal end of the shade material 106 is attached to the hem bar 107. Then the shade material 106 is wrapped about the roller tube 111 until it reaches an opened position where the shade material 106 is substantially fully rolled onto the roller tube 111 as shown in FIG. 6. Referring to FIG. 8, which illustrates a side perspective view of the roller tube assembly 105, the cable cones 140 are aligned with respect to the roller tube 111 such that a start point at which the cable 139 start rolling onto the cable cone 140 (e.g., at the cable hole 143) is positioned substantially opposite an open position roll off point 148—a point at which the shade material 106 rolls off the roller tube 111 when the roller shade 100 is at an opened position. Each cable cone 140 is then slid onto the roller tube 111. At this position, the longitudinal channel 146 of the roller tube 111 will substantially align with one of the index slots 145 of the cable cone 140, such as aligned index slot 145*a* shown in FIG. 8. The cable cones 140 may be further slightly adjusted to fully align an index slot 145*a* with channel 146. An index insert 149 can then be pressed through the aligned index slot 145*a* and into the longitudinal channel 146 to lock the alignment between the roller tube 111 and the cable cone 140 such that they are rotated at the same time. Each index insert 149 can comprise a projection 150 from one or both of its sides that allows the insert 149 to be pressure pressed into position. Referring to FIG. 6, after aligning and sliding both cable cones 140 onto the two opposite ends 115*a-b* of the roller tube 111, the motor drive unit 112 is inserted into the first end 115*a* of the roller tube 111 and the idler 113 is inserted into the second end 115*b* of the roller tube 111. They are inserted until the flanges 116 and 124 of the motor drive unit 112 and idler 113, respectively, abut the circumferential lateral walls 144 of the cable cones 140, thereby locking the cable cones 140 as well as the index inserts 149 in place.

Referring back to FIG. 3, the side panel assemblies 101 and 102 can each comprise U-shaped side channels 130*a-b* each containing tensioning assemblies 109. Referring further to FIGS. 10 and 11, which illustrate exploded perspective views of the side panel assemblies 101 and 102, each side channel 130*a-b* can comprise a side wall 132, a top wall 133, and a bottom wall 134. The inner surface of the side wall 132 can comprise a first longitudinal track 135 proximate to the bottom wall 134 and a second longitudinal track 136 proximate the top wall 133. Tracks 135 and 136 can be used for mounting various shade components to side channels 130*a-b* at any location along the tracks 135 and 136. The shade components can be mounted to tracks 135/136 by sliding a back plate 137 inside a track 135/136 to a desired location and securing the component to the back plate 137 by inserting screws 138 through holes in the components and into threaded holes in the back plate 137. Accordingly, side channels 130*a-b* can be cut to size and assembled to fit any requisite length of the window frame 110. Each side channel 130*a-b* can further comprise a lateral wall 151 extending from the inner surface of the side wall 132 below the top wall 133 such that the lateral wall 151, the rear wall 132 and the top wall 133 form a hem bar channel 152. Each hem bar channel 152 receives wheels 114 on opposite ends of the hem bar 107, which travel along the channel 152 on the lateral wall 151 during operation. Each side channel 130*a-b* can further comprise a lateral wall 131 extending from the inner surface of the bottom wall 134 proximate to its terminal end. In addition, each side panel assembly 101 and 102 may comprise at least a pair of fascia clips 169 secured to the first track 135 via back plates 137 and screws 138 as shown in FIG. 3.

Referring to FIG. 4, which illustrates a partially exploded top perspective view of the skylight roller shade 100, the base panel assembly 104 comprises a U-shaped base channel 130*c*. According to an embodiment, base channel 130*c* may comprise the same configuration as side channels 130*a-b* of the first and second side panel assemblies 101 and 102 in order to reduce the number of part types. Base channel 130*c* can comprise top wall 133, bottom wall 134, and side wall 132 containing first and second longitudinal tracks 135 and 136. At least a pair of fascia clips 169 (not shown) may also be secured to the first track 135 via back plates 137 and screws 138. However, base channel 130*c* of the base panel assembly 104 may comprise a different configuration as well—for example, it need not contain the hem bar channel 152. The base channel 130*c* can be cut to size to accommodate the required width of the window frame 110. Furthermore, base channel 130*c* can comprises an alignment channel 153 recessed in the outer surface of the side wall 132.

Referring to FIG. 3, the head panel 103 may comprise an L-shape having a top wall 165 and a side wall 166 with an alignment channel 167 recessed in the outer surface of the side wall 166. Head panel 103 can further comprise an upwardly slanted lateral wall 168 extending from inner surface of the side wall 166 proximate to its terminal end.

Referring to FIGS. 4, 10, and 11, the side panel assemblies 101 and 102 may further comprise first through fourth corner brackets 154*a-d* adapted to be secured proximal to the terminal ends of each side channel 130*a-b*. Referring to FIG. 10, each corner bracket, such as the first corner bracket 154*a*, can comprise a first portion 155 and a second portion 156 attached to and orthogonal to the first portion 156. The first portion 155 of each corner bracket 154*a-d* is adapted to be secured to the first and second longitudinal tracks 135 and 136 of a respective side channel 130*a-b* via back plates 137 and screws 138. According to an embodiment, the corner brackets 154*a-d* may be standalone brackets, or in another embodiment, other shade components may be integrated into corner brackets 154*a-d* for holding the roller tube assembly 105 as well as the pulleys of the tensioning assemblies 109. Particularly, each first portion 155 of corner brackets 154*a-b* may comprise a fixed pulley bracket 161, the first portion 155 of corner bracket 154*c* may comprise a motor bracket 163, and the first portion 155 of corner bracket 154*d* may comprise an idle bracket 164 (FIG. 11). Each second portion 156 of corner brackets 154*a-d* may comprise a substantially flat wall with an alignment tab 157 linearly extending from its terminal end. The alignment tab 157 may comprise a rectangular shape with a width and thickness adapted to fit within the alignment channels 153 and 167 in the base channel 130*c* and head panel 103.

Referring to FIG. 3, the shade 100 may further comprise fascia sections to substantially conceal the inner component of the shade 100 from view. Particularly, the shade 100 may comprise a first and second side fascia sections 158*a-b* that may substantially conceal the tensioning assemblies 109 inside the side panel assemblies 101 and 102. The shade 100 may also comprise a base fascia section 158*c* that may substantially conceal the hem bar 107 when the shade material 106 is at a closed position. Side and base fascia sections 158*a-c* may comprise substantially the same configuration comprising a substantially flat side wall 171, and various lateral walls 172 extending from the inner surface of the side wall 171. Each side fascia section 158*a-b* may comprise a fascia corner bracket 176 connected to one of its terminal ends. The roller shade 100 may further comprise a head fascia section 159 that may substantially conceal the roller tube portion 111 of the roller tube assembly 105. Head fascia section 159 may comprise an L-shape having a side wall 173 and a bottom wall 174, as well as a hook shaped wall 175 extending from the bottom wall 174.

Shade 100 may be ordered by a consumer by providing measurements of the window frame 110 to the manufacturer. The manufacturer can use the measurements to cut the roller tube 111, the side channels 130*a-b*, the base channel 130*c*, the head panel 103, as well as the side fascia sections 158*a-b*, base fascia section 158*c*, and head fascia section 159 to correspond to the size of the measured window frame 110. The manufacturer will then assemble the roller tube assembly 105 as well as the side and bottom panel assemblies 101, 102 and 104 and ship the assemblies along with the head panel 103, the fascia sections 158*a-c* and 159 to the consumer. During installation, the first and second side panel assemblies 101 and 102 may be secured to the sides of the window frame 110, for example via screws. The screws may be left not fully tightened such that the height of the side panel assemblies 101 and 102 with respect to each other and the window frame 110 may be adjusted.

FIG. 5 illustrates a top perspective view of a portion of an assembled skylight roller shade 100. As shown in FIG. 5, the base panel assembly 104 is installed by aligning its alignment channel 153 with the alignment tabs 157 of the first and second corner brackets 154*a-b* and securing the base panel assembly 104 to the window frame 110, thereby aligning the height of the side panel assemblies 101 and 102 with respect to each other and the window frame 110. Similarly, referring to FIGS. 3 and 4, the head panel 103 is installed by aligning its alignment channel 167 with the alignment tabs 157 of the third and fourth corner brackets 154*c-d* and securing the head panel 103 to the window frame 110 to further align the height of the side panel assemblies 101 and 102 with respect to each other and the window frame 110. The aligned side panel assemblies 101 and 102 may then be tightened to the window frame 110.

The roller tube assembly 105 is then mounted between the side panel assemblies 101 and 102. The roller tube assembly 105 may be first mounted to the second side panel assembly 102 by inserting the pin tip of the idler pin 119 into a keyhole 178 (FIG. 11) in the idle bracket 164 of the fourth corner bracket 154*d*. The roller tube assembly 105 may then be mounted to the first side panel assembly 101 by latching the motor latch bracket 160 to the motor bracket 163 of the third corner bracket 154*c*. Particularly, the motor latch bracket 160 may comprise a pair of spring biased hooked arms 191 (FIG. 6) that latch onto a corresponding pair of pins 192 extending out of the motor bracket portion 160. The hem bar 107 is then installed between the side panel assemblies 101 and 102 by sliding the hem bar wheels 114 into each hem bar channel 152 and onto the lateral wall 151 (FIGS. 10-11). Each cable 139, which is attached at one end to a cable cone 140 of the roller tube assembly 105, is then looped through the pulley wheels 185*a-c* of the tensioning assemblies 109 of respective side panel assemblies 101 and 102 and secured at an opposite end to a respective endcap 108 of the hem bar 107. The tensioning assemblies 109 are then tensioned as discussed further below. The side, head, and base fascia sections 158*a-c* and 159 are then attached to the side, head, and base panels 101-104, respectively. Specifically, the lateral walls 172 of the side and base fascia sections 158*a-c* are snapped to the fascia clips 169 and lateral walls 131 of the side and base panel assemblies 101-102 and 104. The hooked shaped wall 175 of the head fascia section 159 is hooked to the lateral wall 168 of the head panel 103. Screws 177 may then be used to secure the head fascia section 159 to the fascia corner brackets 176. Referring to FIG. 2, the alignment channels 153 and 167 and alignment tabs 157 ensure that the roller shade 100 is squared off and the bottom surface of the side channels 130*a-b*, base channel 130*c*, and the head fascia section 159 are flush with respect to each other.

According to one embodiment, shade 100 may be configured as a single skylight with a single roller tube assembly 105 as shown in FIG. 2. According to another embodiment, shade 100 can be configured as a dual skylight, with two roller tube assemblies 105 and an additional set of tensioning assemblies 109, such that the shade material 106 opens in the middle. This is possible because the side channels 130*a-b* can be cut to any length and the roller tube assembly 105 and tensioning assembly 109 as well as the other components discussed above may be mounted anywhere along the side channels 130*a-b*. In such configuration, longer side channels 130*a-b* will be utilized to house another set of roller tube assembly 105 and tensioning assemblies 109. Instead of a base panel assembly 104, a second head panel will be installed across of the head panel 103 to square off the roller shade and conceal the second roller tube assembly 105.

Reference is now made to FIGS. 10 and 11, FIG. 9, which illustrates an elevational inner view of a side panel assembly 101, and FIG. 12, which illustrates an exploded perspective view of a tensioning assembly 109. Each side panel assembly 101 and 102 comprises a tensioning assembly 109 adapted to tension the shade material 106 such that it travels parallel to the side panel assemblies 101 and 102 and does not sag. When shipped to a consumer, each tensioning assembly 109 may comprise a fixed pulley bracket 161, a floating pulley bracket 162, a spring 180, a traveler tension bracket 181, an anchor tension bracket 182, a threaded bolt 183, and a tension assist bracket 184. The fixed pulley bracket 161 is fixedly attached to the first and second longitudinal tracks 135 and 136 proximate to each terminal end of the side channels 130*a-b* using back plates 137 and screws 138 as discussed above. The fixed pulley bracket 161 contains a pair of pulley wheels 185*a-b*. The floating pulley bracket 162 is disposed adjacent to the fixed pulley bracket 161 and contains a third pulley wheel 185*c*. The tension assist bracket 184 is removably attached to and between the fixed pulley bracket 161 and the floating pulley bracket 162 via screws 186 to keep the floating pulley bracket 162 fixed during shipping and installation. The spring 180 is attached at one of its terminal ends to the floating pulley bracket 162 and at its other terminal end to the traveler tension bracket 181, for example by looping the spring's ends into hooks. The traveler tension bracket 181 contains a pair of longitudinal arms 187 adapted to be slidably received by the first and second longitudinal tracks 135 and 136 of a side channel 130*a/b* such that the traveler tension bracket 181 can longitudinally translate with respect to the side channel 130*a/b* of the side panel assembly 101/102. The anchor tension bracket 182 is fixedly attached to the first and second longitudinal tracks 135 and 136 of the side channel 130*a/b* using back plates 137 and screws 138. The threaded bolt 183 is attached to and between the traveler tension bracket 181 and the anchor tension bracket 182 by inserting the bolt 183 through holes in the brackets and securing the bolt 183 with at least one threaded nut 188. The bolt 183 may be tightened or loosened to bring the traveler tension bracket 181 closer or farther from the anchor tension bracket 182, respectively.

Referring to FIG. 13A, the side channels 130*a* and 130*b* of the first and second side panels 101 and 102 are attached to the window frame 110 with the tension assist bracket 184 secured to and between the fixed pulley bracket 161 and the floater pulley bracket 162. Each cable 139, which is attached on one end to the cable cones 140, is looped through the first pulley 185*a*, the third pulley 185*c*, and the second pulley 185*b* as shown in FIGS. 9 and 13B. The other end of each cable 139 is then snugly secured to an end cap 108 of the hem bar 107. Referring to FIG. 13C, the tension assist bracket 184 may then be remove from between the fixed pulley bracket 161 and floating pulley bracket 162 by unscrewing screws 186. This leaves the pulley bracket 162 "floating" between the spring 180 and the fixed pulley bracket 161 via pull of the cable 139. Each tensioning assembly 109 may then be tensioned by tightening the nut 188 on the bolt 183 a requisite number of turns to pull the traveler tension bracket 181 towards the anchor tension bracket 182. The traveler tension bracket 181, thereby, pulls one end of the spring 180 away from the other end of the spring 180 that is attached to the floating pulley bracket 162 to tension the spring 180 and tighten the cable 139. The nut 188 may be tightened or untightened to achieve the desired tension in the tensioning assembly 109.

Referring to FIGS. 9 and 13C, during operation as the roller tube 111 rotates via motor 125 to close a window, the shade material 106 is unrolled from the roller tube 111 and the cables 139 are rolled onto the helical groove 142 of the cable cones 140. This causes the cables 139, which are fed through the pulley wheels 185*a-c* and tensioned through the tensioning assemblies 109, to pull on the hem bar 107. As the hem bar 107 translates parallel to the side panel assemblies 101 and 102 via wheels 114 along the hem bar channels 152, it pulls on the shade material 106 such that it also travels substantially parallel to the side panel assemblies 101. The provided tension by the tensioning assemblies 109 ensures the shade material 106 does not drape.

INDUSTRIAL APPLICABILITY

To solve the aforementioned problems, the aspects of the embodiments are directed toward systems, methods, and modes for a skylight roller shade that can be easily customized to size, assembled, installed, and tensioned. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

ALTERNATE EMBODIMENTS

Alternate embodiments may be devised without departing from the spirit or the scope of the different aspects of the embodiments. The embodiments described herein may be used for covering windows as well as doors, wall openings, or the like. The embodiments described herein may further be adapted in other types of window or door coverings, such as inverted rollers, Roman shades, Austrian shades, pleated shades, blinds, shutters, garage doors, or the like.

The invention claimed is:

1. A roller shade adapted to adjustably cover a structural opening comprising:

a pair of longitudinal side panel assemblies adapted to be attached at opposite sides of the structural opening, wherein each of the side panel assemblies comprises a tensioning assembly;

a roller tube assembly adapted to be attached to and between the pair of longitudinal side panel assemblies, wherein the roller tube assembly comprises:

a roller tube comprising at least one channel;

a shade material attached to the roller tube, wherein the shade material is adapted to unroll from the roller tube from an opened position to a closed position;

at least one cable cone secured to an end of the roller tube and comprising a lateral wall comprising a plurality of index slots disposed at radial intervals along the lateral wall;

at least one index insert; and at least one cable;

wherein the cable is adapted to be wound about the cable cone, be tensioned by one of the tensioning assemblies, and be attached to a free end of the shade material;

wherein the cable cone is adapted to be aligned with respect to the roller tube to an aligned position at which one of the index slots is substantially aligned with the at least one channel in the roller tube; and wherein the index insert is adapted to be inserted through the substantially aligned index slot and into the channel in the roller tube to lock the alignment between the roller tube and the cable cone.

2. The roller shade according to claim 1, wherein the aligned position is a position at which a start point, at which the cable starts rolling onto the cable cone, is positioned substantially opposite an open position roll off point, at which the shade material rolls off the roller tube when the roller shade is at the opened position.

3. The roller shade according to claim 2, wherein the cable cone comprises a hole into which a terminal end of a respective cable is inserted and anchored, wherein the hole corresponds to the start point.

4. The roller shade according to claim 1, wherein the cable cone comprises a through bore, wherein the cable cone is adapted to slide onto the end of the roller tube.

5. The roller shade according to claim 4, wherein the lateral wall comprises a circumferential wall extending from an inner surface of the bore inside the cable cone.

6. The roller shade according to claim 1, wherein the at least one channel longitudinally extends and recessed in an outer surface of the roller tube.

7. The roller shade according to claim 6, wherein the at least one channel is further adapted to secure the shade material to the roller tube.

8. The roller shade according to claim 1, wherein the cable cone comprises a helical groove, wherein the cable is adapted to wound on the helical groove of the cable cone.

9. The roller shade according to claim 1, wherein the index insert comprises a projection adapted to pressure fit the index insert into the aligned index slot.

10. The roller shade according to claim 1, wherein the roller tube assembly further comprises a motor drive unit and an idler attached at opposite ends of the roller tube, wherein one of the motor drive unit and the idler comprises a flange adapted to abut the lateral wall of the cable cone to secure the cable cone and the index insert to the roller tube.

11. The roller shade according to claim 1, wherein at least one tensioning assembly comprises:

a fixed pulley bracket comprising a first and second pulleys;

a floating pulley bracket comprising a third pulley; and a spring attached at one end to the floating pulley bracket;

wherein the cable is looped through the first, second, and third pulleys of the tensioning assembly.

12. The roller shade according to claim 1, wherein the roller tube assembly further comprises a shade drive unit adapted to rotate the roller tube to unroll or roll the shade material to adjustably cover or uncover the structural opening.

13. The roller shade according to claim 3, wherein the shade drive unit comprises a motor.

14. The roller shade according to claim 1, wherein the roller tube assembly further comprises a hem bar attached to the free end of the shade material, and wherein the cable is attached to the hem bar.

15. The roller shade according to claim 14, wherein the hem bar comprises wheels extending from opposite ends of the hem bar, wherein each side panel assembly comprises a longitudinal hem bar channel adapted to receive at least one of the wheels to guide the hem bar along the side panel assembly.

16. The roller shade according to claim 15, wherein each hem bar channel comprises a longitudinal lateral wall upon which the at least one wheel rolls.

17. A roller shade adapted to adjustably cover a structural opening comprising:

a pair of longitudinal side panel assemblies adapted to be attached at opposite sides of the structural opening, wherein each of the side panel assemblies comprises a tensioning assembly;

a roller tube assembly adapted to be attached to and between the pair of longitudinal side panel assemblies, wherein the roller tube assembly comprises:

a roller tube comprising a channel;

a shade material attached to the roller tube, wherein the shade material unrolls from the roller tube from an opened position to a closed position;

a pair of cable cones attached at opposite ends of the roller tube, wherein each of the cable cones comprises a lateral wall comprising a plurality of index slots disposed at radial intervals along the lateral wall;

a pair of cables; and a pair of index inserts;

wherein the cables are adapted to be wound about the respective cable cones, be tensioned by the respective tensioning assemblies, and be attached to a free end of the shade material;

wherein each of the cable cones is adapted to be aligned with respect to the roller tube to an aligned position at which a start point, at which one of the cables starts rolling onto one of the cable cones, is positioned substantially opposite an open position roll off point, at which the shade material rolls off the roller tube when the roller shade is at the opened position;

wherein at the aligned position at least one of the index slots is substantially aligned with the channel in the roller tube; and wherein one of the index inserts is adapted to be inserted through the substantially aligned index slot and into the longitudinal channel to lock the alignment between the roller tube and one of the cable cones.

18. A method of assembling a roller shade comprising a roller tube assembly having a shade material adapted to adjustably cover a structural opening and a pair of longitudinal side panel assemblies adapted to be attached at opposite sides of the structural opening and each having tensioning assemblies adapted to tension the shade material, wherein the method comprises:

attaching the shade material to a roller tube, wherein the roller tube comprises a channel;

rolling the shade material onto the roller tube until reaching an opened position where the shade material is substantially rolled onto the roller tube;

aligning at least one cable cone with respect to an end of the roller tube to an aligned position, wherein the cable cone comprises a lateral wall comprising a plurality of index slots disposed at radial intervals along the lateral wall, where at the aligned position one of the index slots is substantially aligned with the channel in the roller tube;

inserting an index insert through the substantially aligned index slot and into the channel in the roller tube to lock the alignment between the roller tube and the cable cone; and attaching a cable to the at least one cable cone, wherein the cable is adapted to be wound about the cable cone, be tensioned by one of the tensioning assemblies, and be attached to a free end of the shade material.

19. The method according to claim 18, wherein the aligned position is a position at which a start point, at which the cable starts rolling onto the cable cone, is positioned substantially opposite an open position roll off point, at which the shade material rolls off the roller tube when the roller shade is at the opened position.

20. The method according to claim 18, wherein the cable cone comprises a through bore, wherein the method further comprises a step of sliding the cable cone onto the roller tube after aligning the cable cone with the roller tube.

21. The method according to claim 18, wherein the roller tube assembly further comprises a motor drive unit and an idler, wherein one of the motor drive unit and the idler slot comprises a flange, wherein the method further comprises the step of inserting one of the motor drive unit and the idler into the roller tube until the flange abuts the lateral wall of the cable cone to secure the cable cone and the index insert to the roller tube.

* * * * *